United States Patent [19]

Fox

[11] 4,130,197

[45] Dec. 19, 1978

[54] DISPLAY DEVICE

[75] Inventor: Philip R. Fox, Cincinnati, Ohio

[73] Assignee: Midwest Bindery Enterprises, Inc., Cincinnati, Ohio

[21] Appl. No.: 858,194

[22] Filed: Dec. 7, 1977

[51] Int. Cl.[2] ..... B65D 5/52

[52] U.S. Cl. ..... 206/45.26; 206/45.29; 206/425; 206/464; 206/491; 248/459; 40/124.2

[58] Field of Search ..... 206/44 R, 44 B, 45.26, 206/45.29, 461, 464, 467, 470, 491, 806, 425; 229/16 D; 248/459; 40/124.1, 124.2, 124.4

[56] References Cited

U.S. PATENT DOCUMENTS

| | | | |
|---|---|---|---|
| 677,108 | 6/1901 | Weis | 206/44 R |
| 1,011,697 | 12/1911 | Witkowski | 206/462 |
| 2,946,545 | 7/1960 | Sampson | 248/459 |
| 3,237,836 | 3/1966 | Nowak et al. | 229/160 |
| 3,292,290 | 12/1966 | Potter | 206/491 |
| 3,294,233 | 12/1966 | Hollinger | 206/491 |
| 3,459,298 | 8/1969 | Quenot | 206/491 |
| 3,739,511 | 6/1973 | Freedman | 40/124.1 |
| 3,904,029 | 9/1975 | Koltz | 206/806 |
| 3,985,232 | 10/1976 | Johnson | 206/461 |
| 4,001,958 | 1/1977 | Fecko | 248/459 |

FOREIGN PATENT DOCUMENTS

| | | | |
|---|---|---|---|
| 67,831 | 10/1957 | France | 206/491 |
| 215453 | 9/1967 | Sweden | 206/461 |

*Primary Examiner*—William Price
*Assistant Examiner*—Bruce H. Bernstein
*Attorney, Agent, or Firm*—Alfred J. Mangels

[57] ABSTRACT

A display card blank for forming a display card having an integral pocket. The pocket is particularly adapted to hold coupons, recipes, or other informations in printed form, and the display card itself is so arranged that it can be hung from hooks, or it can be positioned on a shelf and held in position by the weight of the product involved, or it can be set up in an easel arrangement to display the message on the card and the articles in the pocket, or it can be attached to a pole-type display. The display card blank is so configured that only a single printing pass is needed to print both the card surface and the front panel of the pocket.

9 Claims, 3 Drawing Figures

DISPLAY DEVICE

BACKGROUND OF THE INVENTION

This invention relates to a display card and a blank therefor having a pocket adapted to receive and permit the dispensing of sheets of printed matter. More particularly, the invention relates to a display card blank which is so arranged that the article-retaining pocket is integral with the card when the same is assembled.

The provision of a display card or sign bearing advertising material or related matter is, of course, well known. Likewise, it is also well known to attach coupons or other printed matter on such a card in such a way that consumers can remove such printed matter if they care to do so. Frequently such printed matter is provided in pad form which is then either stapled or glued to the display card in a position which does not interfere with the advertising or other message printed on the card, and is also in a position which is readily accessible to consumers to whom the message is directed.

In providing display cards which incorporate printed matter removable by a series of consumers, the approach which utilizes a pad of printed matter affixed to the display card provides a cumbersome and costly approach to the dissemination of the desired material. For example, the stapling or gluing of the padded printed material requires a separate and distinct operation thereby increasing the cost of the assembly by requiring additional handling. Similarly, when the pad of printed matter is completely exhausted, the remaining display card must be discarded and an entirely new card with attached pad substituted therefor to provide additional printed matter for successive consumers. Thus there is the additional cost of an entirely new display card each time a pad of the printed matter has been exhausted.

The prior art has recognized several of those deficiencies and attempts have been made to overcome them. For example, U.S. Pat. No. 3,292,290, issued on Dec. 20, 1966 to Ralph C. Potter, discloses a display unit formed from a single sheet which can be used for display and dispensing. That patent makes reference to the advantages of a single unit in terms of lower cost by reason of the elimination of the separate gluing or stapling operations.

Additionally, in U.S. Pat. No. 3,739,511, issued on June 19, 1973, to William B. Greedman, there is disclosed a display card with a separately formed pocket, a portion of which must be attached to the display card by means of staples or gluing. Additionally, Freedman discloses a display card with an integral pocket, but the structure of the pocket is so arranged that printing of the face of the display card and of the face of the front panel of the article retaining pocket must be done in two separate passes on a printing press since each of those faces is oppositely disposed on the blank utilized to form that structure. The requirement that printing be applied to the face of the display card and to the front panel of the article-retaining pocket would require substantial additional costs because of the additional printing operation.

Furthermore, in U.S. Pat. No. 4,001,958, issued Jan. 11, 1977, to Francis D. Fecko, there is disclosed a display card wherein the card and its associated pocket are formed from a single sheet of material. However, the device disclosed in that patent is so arranged that the article-retaining pocket is offset from the edge of the display card, thereby reducing the unobstructed area on which advertising or other messages can be printed. Additionally, the Fecko card uses a double thickness main panel, thereby substantially increasing the cost of the card.

It is an object of the present invention to obviate the above-described difficulties.

SUMMARY OF THE INVENTION

Briefly stated, in accordance with one aspect of the present invention, a display card blank is provided having integral panels therein which can be assembled to form a display card having an integral pocket. The display card blank includes a main panel which incorporates a foldable glue flap formed by a score line and intersecting die cuts, and also includes a bottom panel which depends from one edge of the main panel and is hingedly attached thereto by means of a score line. Hingedly connected to the main panel by another score line is a first side panel to which is hingedly connected an inner wall panel, and to which, in turn, is connected a second side panel. Depending from one of the remaining edges of the inner wall panel is an outer wall panel which is hingedly connected thereto by means of a score line. The panels when folded together and when the second side panel is glued to the glue flap in the main panel provides a display card with an integral article-retaining pocket suitable for retaining printed matter.

DESCRIPTION OF THE PREFERRED EMBODIMENTS

Figure 1:
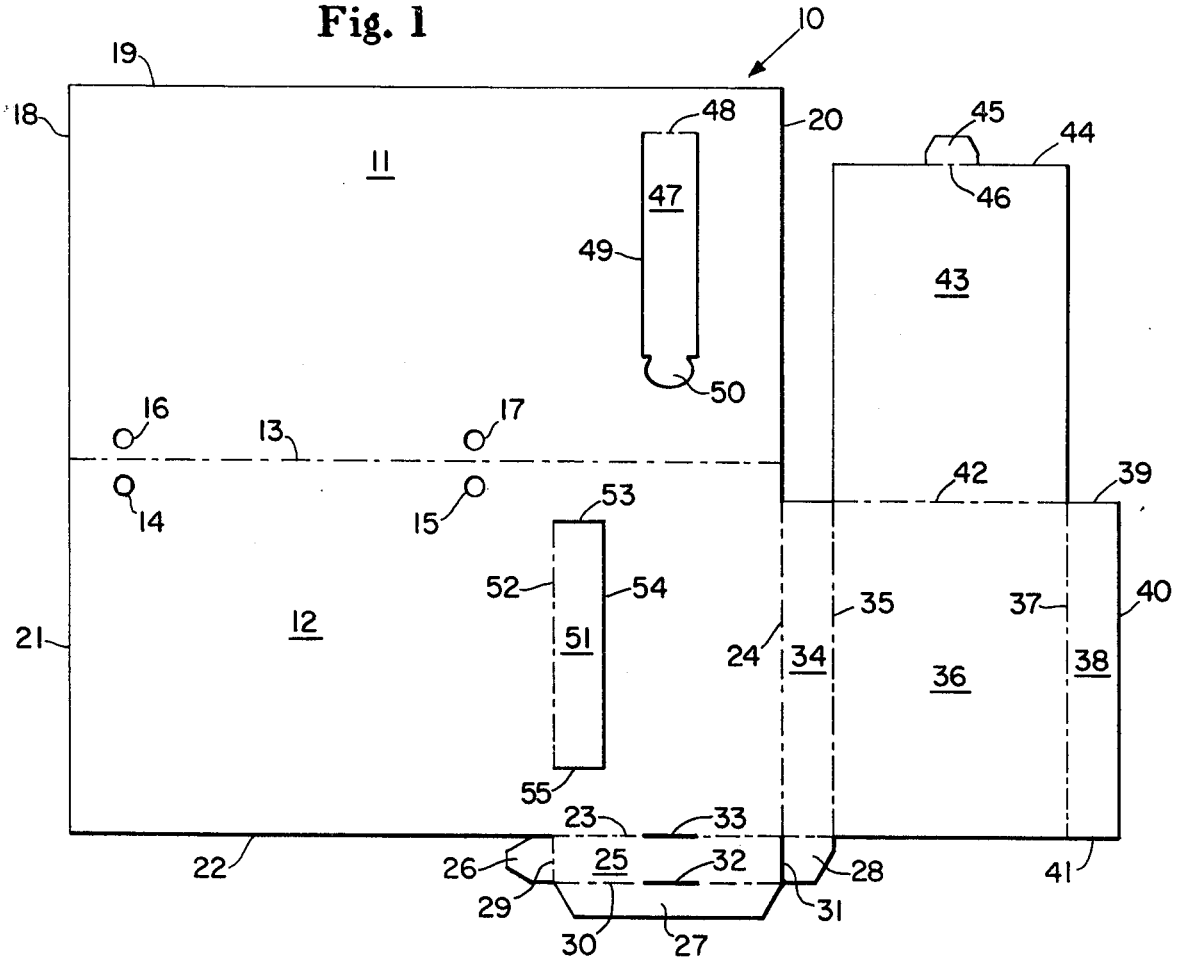
FIG. 1 is a plan view of a display card blank suitably cut and scored and from which a display card having an integral article-retaining pocket can be formed according to the present invention.

Referring now to the drawings and particularly to FIG. 1 thereof, there is shown a flat display card blank 10 from which the display card of the present invention can be formed. Display card blank 10 comprises rear panel 11 and main panel 12 which are hingedly connected by means of a score line 13. The score line is so positioned as to provide the surface area desired for the main panel and the surface area desired for the rear panel. Rear panel 11 is an optional feature of the display card in that it is not essential that such a card have such a rear panel.

Card 10 could be displayed from hooks which extend through apertures 14 and 15 formed in main panel 12 to permit the card to be hung in the desired position. Alternatively, if it is desired to exhibit the display card where hooks or similar devices are unavailable, rear panel 11 could be provided and could serve to position the display card on a shelf (not shown) in such a manner that rear panel 11 lies on the top surface of the shelf and main panel 12 hangs from the front edge of the shelf in the desired position. When so arranged, it would be necessary to apply some weight to rear panel 11 to offset the weight of main panel 12 and prevent the entire device from falling from the shelf. That weight can conveniently be provided by means of the produce with which the display card is associated, or rear panel 11 can be taped to the shelf to secure the card in position. Moreover, for even greater applicability of the display card, both rear panel 11 and apertures 14 and 15 can be provided to eliminate the need to provide different card structures for different display arrangements. In that event, apertures 16 and 17 can be provided in rear panel 11 to permit wire hangers, or the like, to protrude through both rear panel 11 and main panel 12 when the device is displayed in the hanging mode. Apertures 16 and 17 in rear panel 11 are in that case positioned opposite to apertures 14 and 15 in main panel 12 and the apertures in each panel are positioned the same distance from score line 13 so that the respective apertures are coincident when rear panel 11 is folded over in back-to-back relationship with main panel 12. Additionally, if desired, rear panel 11 can be configured in such a way as to provide the supporting structure for an easel-type arrangement to permit the display card to be stood on any flat surface. Such as easel arrangement will be hereinafter described in more detail.

Rear panel 11 is defined by edges 18, 19 and 20, and by score line 13 of the display card, while main panel 12 is defined by edges 21 and 22 and by score lines 23, 24, and 13. Score line 23 also separates main panel 12 from bottom panel 25, which depends from main panel 12 and is hingedly connected thereto by means of score line 23. Bottom panel 25 forms the bottom panel of the article-retaining pocket when the latter is completely formed. If desired, tabs 26, 27, and 28 can be provided to completely close the bottom of the pocket. Tab 26 is hingedly connected to bottom panel 25 by score line 29; tab 27 is hingedly connected to bottom panel 25 by score line 30; and tab 28 is hingedly connected to bottom panel 25 by score line 31. Additionally, it is desirable that a lengthwise cut 32 be provided in a portion of score line 30 for reasons which will hereinafter be described. If it is desired to erect and position the display card of the present invention by means of an easel arrangement, it would be desirable to provide a lengthwise cut 33 in a portion of score line 23, again for reasons to be hereinafter described.

Hingedly attached to main panel 12 by means of a score line 24 is first side panel 34, which is preferably of a rectangular conformation and which defines a side panel of the article-retaining pocket. Hingedly connected to first side panel 34 by means of score line 35 is an inner wall panel 36 which defines the frontal area of the article-retaining pocket. Hingedly connected by score line 37 to the opposite side of inner wall panel 36 from first side panel 34 is second side panel 38, which is defined by score line 37 and by edges 39, 40, and 41. Hingedly connected to inner wall panel 36 along score line 42 is outer wall panel 43. Depending from the edge 44 of outer wall panel 43 is tab 45, which is hingedly attached to outer wall panel 36 by means of score line 46. The display card 10 of the present invention also includes a glue flap 51, formed in the interior portion of main panel 12 by means of score line 52 and by cut lines 53, 54, and 55. The purpose of glue flap 51 is to provide a rigid member to which second side panel 38 can be permanently attached to form a tube-like structure, which can be shipped flat and later erected by the user in the manner to be hereinafter described.

In providing the display card of the present invention, any of a number of different types of paperboard could be employed. Since it is desirable to provide such a device together with printed matter in the form of an advertising message or in the form of instructional matter or the like, it is desirable that the board utilized to form such a card be of such a type that it can be easily printed and in a high quality manner. The type of board used can be, for example, solid bleached sulfate, white patent coated cylinder board, and the like, all of which are well know to those skilled in the art. Although the particular board material used is not critical, the solid bleached sulfate board is preferred since it presents a hard, smooth surface desired for quality printing. Similarly, the thickness of the board is not critical and it is also well within the skill of those versed in the art to select a board of suitable thickness, although when a solid bleached sulfate board is utilized to provide such a display card, a board having a thickness of about 24 mils is preferred.

Figure 2:
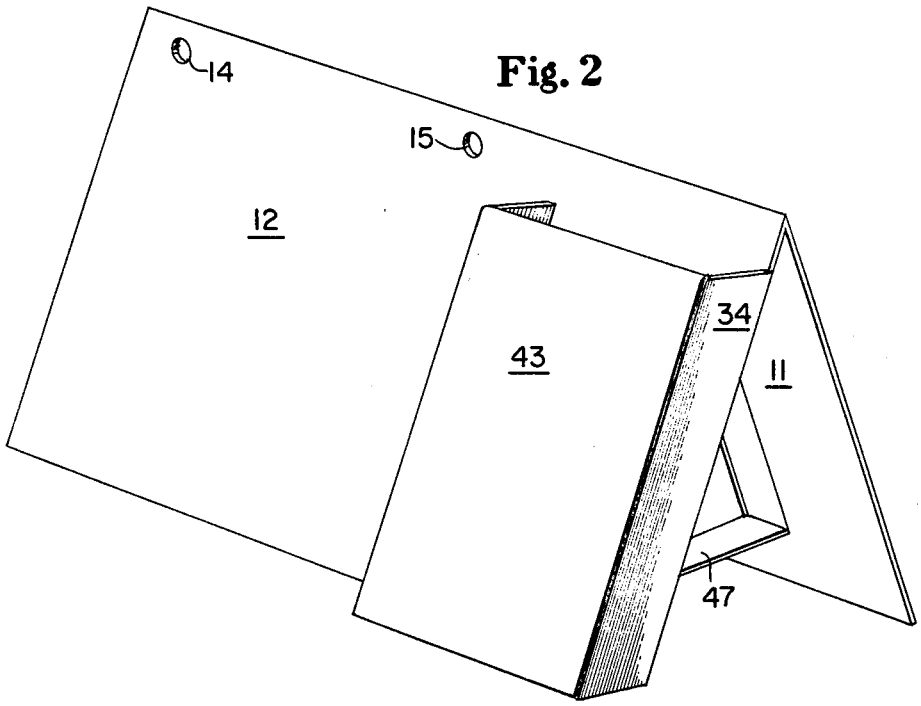
FIG. 2 is a perspective view of an erected display card formed from the blank of FIG. 1.

As was mentioned earlier, the present invention can be utilized several different ways: by hanging from hooks or the like, in which case apertures 14 and 15 in main panel 12 could be utilized for that purpose, and in which event rear panel 11 would not be necessary, but if it were present, apertures 16 and 17 could be provided for the hooks to pass through; by providing rear panel 11 to be placed upon the produce shelf and upon which the product sits to hold the display card in position, or, alternatively, instead of the product holding the panel in position, the rear panel can be secured to the product shelf by other means such as by taping, by glue, or the like; and the display card can also be erected in an upright position in such a way as to be self-supporting, as shown on FIG. 2 of the drawings. In the latter case it is desirable that there be provided with the card of the present invention an integral means to support it in an upright position. An integral means is desired because non-integral means would require gluing or stapling additional parts to the card, thereby requiring additional operations to be performed thereto, consequently increasing its cost. In its preferred form, the self contained erecting device would consist of joining member 47 which is formed in rear panel 11 by means of a score line 48 and cut line 49 which defines an elongated element having a tab-type end 50. During assembly of the device, tab-type end 50 can be inserted in lengthwise cut 33 formed in score line 23 which separates main panel 12 from bottom panel 25.

In assembling the display card of the present invention, it is desirable to provide a card in accordance with the configuration shown in FIG. 1 of the drawing, which card is then adapted for ultimate use by securing second side panel 38 to glue flap 51 in main panel 12. That operation can be performed on suitable gluing apparatus (not shown) which applies a glue strip (not shown) either to glue flap 51 or to the face of second side panel 38, whereupon second side panel 38 is adhered to glue flap 51 by folding the blank along score line 35 to form a tubular structure. The blank can then be shipped flat for later erection by the user.

In erecting the card to permit the utilization of the article-containing pocket, bottom panel 25 is first folded outwardly toward the outer surface of inner wall panel 36. Then inner wall panel 36 is pulled away from main panel 12 to form the tubular structure heretofore referred to, and tabs 26, 27, and 28 associated with bottom panel 25 are tucked in along the inner faces of second side panel 38, inner wall panel 36, and first side panel 34, respectively. Thereafter, outer wall panel 43 is rotated about score line 42 to be in overlying relationship with the outer surface of inner wall panel 36 and tab 45 is tucked into lengthwise cut 32 to secure outer wall panel 43 in relation to inner wall panel 36, and thereby form a substantially rigid, article-containing pocket.

It will be seen that because of the configuration of the display card of the present invention, main panel 12 and outer wall panel 43 may be printed in a single pass on a printing machine, and it is not necessary that the opposite face of the display card be printed in any way. Additionally, it also is apparent that, if desired, the portion of main panel 12 which forms part of the inner surface of the article-retaining pocket, together with the inside of first side panel 34, the inside of inner wall panel 36, and the inside of second side panel 38 can each be printed a distinctive color to enhance the visual appeal of the entire card.

Figure 3:
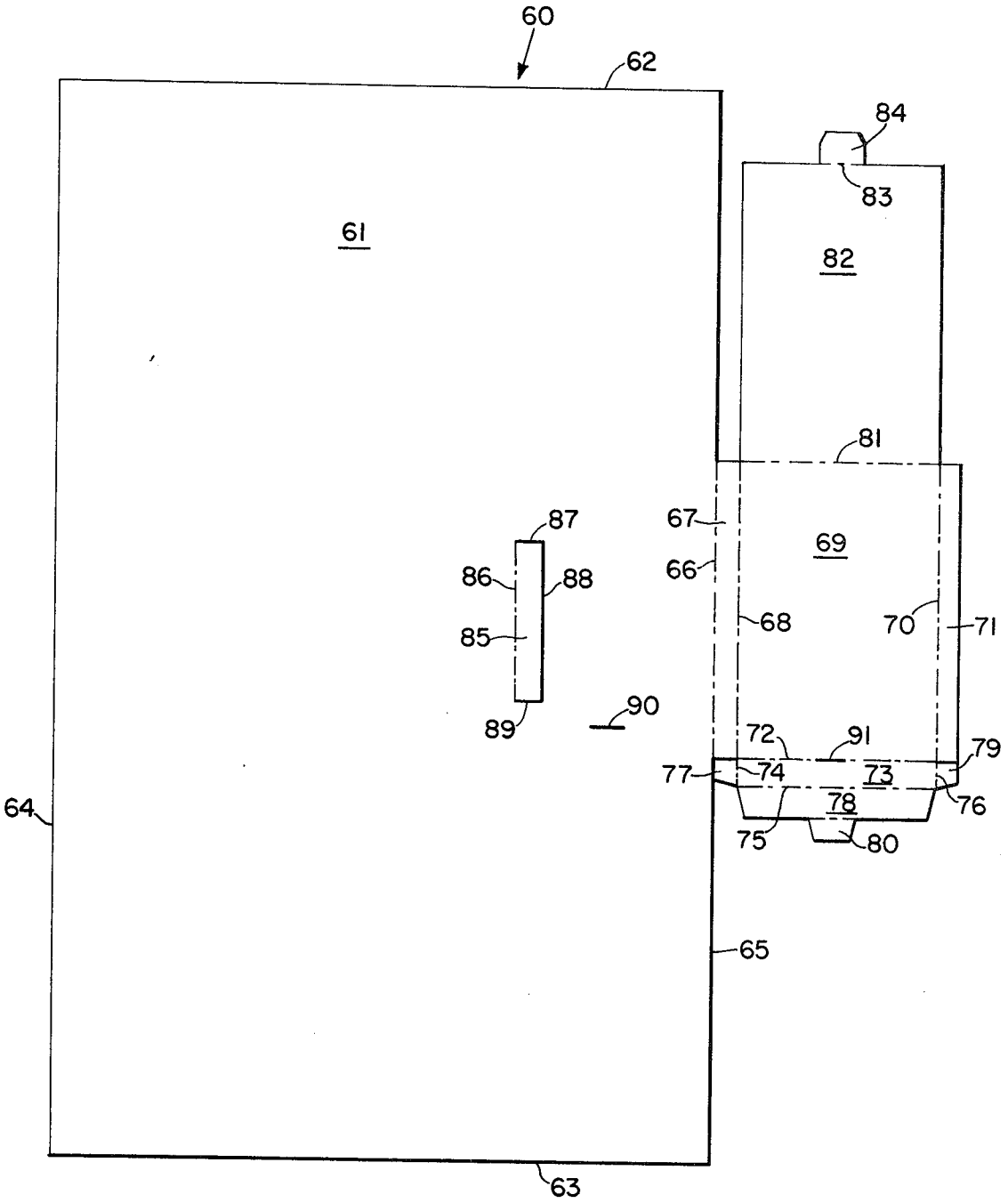
FIG. 3 is another embodiment of the present invention having the article-retaining pocket in a different position from the embodiment of FIG. 1.

A further embodiment of the invention is shown in FIG. 3 of the drawing, wherein is shown a display card blank 60 similar to that shown in FIG. 1 except that the article-retaining pocket is positioned along a side edge of the card intermediate to the top and bottom edges and not at a corner of the card.

In the embodiment of FIG. 3 the display card blank 60 comprises a main panel 61 defined by top and bottom edges 62 and 63, respectively, and left and right side edges 64 and 65, respectively. Along edge 65 there is hingedly attached by means of score line 66 a rectangular first side panel 67. Hingedly attached to first side panel 67 along score line 68 is inner wall panel 69, and hingedly attached to inner wall panel 69 along score line 70 is second side panel 71. Depending from the lower edge 72 of inner wall panel 69 is bottom panel 73, which is hingedly attached thereto by means of a score line which defines edge 72. Hingedly attached to bottom panel 73 by means of score lines 74, 75, and 76 are tabs 77, 78, and 79, respectively. Tab 78 includes a narrow projection 80, the purpose of which will hereinafter be explained.

Hingedly attached to the upper edge 81 of inner wall panel 69 by means of a score line which defines upper edge 81 is outer wall panel 82, and hingedly attached to outer wall panel 82 along score line 83 is tab 84.

Main panel 61 includes a glue flap 85, which is defined by a score line 86, and by cut lines 87, 88, and 89, respectively. Additionally, if desired, main panel 61 can incorporate suitable apertures (not shown) which permit the display card 62 to be slid onto a pole (not shown) to form part of a pole display in a manner well known to those skilled in the art.

The formation of the article-retaining pocket in the embodiment of FIG. 3 is similar to that of the embodiment of FIG. 1. Inner wall panel 69 and second side panel 71 are rotated about score line 68 so that second side panel 71 is in overlying relationship to glue flap 85. The two are then glued together and thereafter a tubular structure results when the inner face of inner wall panel 69 is separated from the front face of main panel 61. Thereafter the various elements are arranged as in the embodiment shown in FIG. 1, except that the bottom is formed by folding tabs 77, 78, and 79 inwardly and inserting tab 80 into cut 90 to secure the bottom of the article-retaining pocket. Thereafter outer wall panel 82 is rotated about score line 81 to be in abutting relationship with inner wall panel 69 and thereafter tab 84 is inserted in cut 91 to secure the structure.

While particular embodiments of the invention have been illustrated and described, it will be apparent to those skilled in the art that various changes and modifications can be made without departing from the spirit and scope of the invention, and it is intended to cover in the appended claims all such changes and modifications that are within the scope of this invention.

What is claimed is:

1. A display card blank for forming a display card having an integral pocket, said blank comprising:

(a) a main panel including a foldable glue flap formed therein by a score line and intersecting cut lines;

(b) a first side panel hingedly connected to said main panel by means of a score line parallel to the score line forming one edge of said glue flap;

(c) an inner wall panel hingedly connected to said first side panel by means of a score line, said inner wall panel having its longitudinal dimension equal to the longitudinal dimension of said first side panel;

(d) a second side panel hingedly connected to said inner wall panel by means of a score line, said second side panel having its longitudinal dimension equal to the longitudinal dimension of said first side panel and parallel thereto;

(e) an outer wall panel hingedly connected to said inner wall panel by means of a score line, said outer wall panel being positioned along a free edge of said inner wall panel; and (f) closure means for effecting closure at the bottom of said integral pocket.

2. The display card blank of claim 1 wherein said main panel includes at least one aperture for mounting the card on a projecting support.

3. The display card blank of claim 1 wherein said closure means comprises a bottom panel depending from one edge of said main panel and hingedly attached thereto by means of a score line, said bottom panel having its longest side disposed generally perpendicularly to an imaginary extension of the longest side of said glue flap.

4. The display card blank of claim 3 including a cut in and along the score line separating said main panel from said bottom panel, a rear panel hingedly attached to said main panel along an edge thereof which is opposite to said bottom panel, said rear panel including a connecting member formed therein by cut and score lines defining an elongated connection member having a tab at its free end thereof spaced from said score line, whereby said tab of said connecting member is adapted to engage with said cut in said score line separating said main panel from said bottom panel.

5. The display card blank of claim 1 wherein said closure means comprises a bottom panel depending from one edge of said inner wall panel and hingedly attached thereto by means of a score line.

6. A display card for displaying informative matter together with means for making available for self-service a quantity of supplemental information which can be stored in an integral pocket on the card and taken by individuals interested therein, said display card comprising:

(a) a main panel;

(b) an article-retaining pocket integrally formed with said main panel and attached thereto, said article-retaining pocket having a portion of said main panel as the rear wall thereof and further comprising:

(1) a first side panel hingedly connected to said main panel and substantially perpendicular thereto;

(2) an inner front wall panel hingedly connected to said first side panel and substantially perpendicular thereto;

(3) an outer front wall panel hingedly connected to said inner front wall panel and in superposed relationship therewith to form a front wall panel of two layer construction;

(4) a second side panel hingedly connected to said inner wall panel and substantially perpendicular thereto; and (5) a bottom panel substantially perpendicular to said first and second side panels and to said inner wall panel, said bottom panel including means cooperable with means connected to said outer front wall panel to hold said outer front wall panel in superposed relationship to said inner front wall panel;

whereby said panels form an article-retaining pocket having said main panel as one wall thereof.

7. The display card of claim 6, including at least one aperture in said main panel for mounting said card on a projecting support.

8. The display card of claim 7, including a rear panel hingedly connected to said main panel along an edge thereof opposite from the edge along which said bottom panel depends.

9. The display card of claim 8 including means for maintaining said card is self-supporting, substantially erect position, said means comprising a connecting member formed in said rear panel and adapted to cooperatively engage with a lengthwise cut in said main panel to form an easel.

* * * * *